US005823617A

United States Patent [19]

Schafer

[11] Patent Number: 5,823,617

[45] Date of Patent: Oct. 20, 1998

[54] MISTING CHAIR

[76] Inventor: Richard D. Schafer, 13104 NE. 89th St., Vancouver, Wash. 98682-2998

[21] Appl. No.: 910,101

[22] Filed: Aug. 13, 1997

Related U.S. Application Data

[60] Provisional application No. 60/024,277, Aug. 21, 1996.

[51] Int. Cl.[6] ..... A47C 7/72

[52] U.S. Cl. ..... 297/180.15; 239/289; 297/22; 297/31; 297/39; 297/217.1

[58] Field of Search ..... 297/180.15, 217.1, 297/22, 31, 39; 239/289

[56] References Cited

U.S. PATENT DOCUMENTS

| | | | |
|---|---|---|---|
| D. 297,991 | 10/1988 | Boyle, Jr. | D6/361 X |
| D. 309,836 | 8/1990 | Meredith et al. | D6/361 |
| 3,625,434 | 12/1971 | Kitover | 297/180.15 X |
| 4,548,357 | 10/1985 | Schmidt | 297/180.15 X |
| 4,765,542 | 8/1988 | Carlson | 297/180.15 X |
| 4,846,525 | 7/1989 | Manning | 297/180.15 |
| 4,854,502 | 8/1989 | Cox | 297/180.15 X |
| 4,961,535 | 10/1990 | Skibik | 297/180.15 X |
| 5,000,384 | 3/1991 | Arnold | 297/180.15 X |
| 5,156,339 | 10/1992 | Gibson et al. | 239/289 |
| 5,322,342 | 6/1994 | Gange | 297/180.15 |
| 5,613,731 | 3/1997 | Aspinall | 297/180.15 |
| 5,722,596 | 3/1998 | Dome | 297/180.15 X |

FOREIGN PATENT DOCUMENTS

| | | |
|---|---|---|
| 0 578 378 | 1/1994 | European Pat. Off. . |
| 94/17695 | 8/1994 | WIPO . |

*Primary Examiner*—Peter M. Cuomo
*Assistant Examiner*—Rodney B. White
*Attorney, Agent, or Firm*—Richard C. Litman

[57] ABSTRACT

A lounge chair that sprays a fine mist on the occupant. Plastic tubing carrying pressurized water passes into and channels through the hollow frame of the lounge chair. The tubing connects on one end to a garden hose, hose bib or other devices of delivering water, through an "on-off" control valve. Misting devices are set into and spaced along the frame. The narrow diameter plastic tubing easily threads through the frame and about the pivots of the lounge chair. Because of the small size of the mister assembly, no structural integrity of the lounge chair is compromised.

4 Claims, 2 Drawing Sheets

MISTING CHAIR

CROSS-REFERENCE TO RELATED APPLICATION

This application claims the benefit of U.S. Provisional patent application Ser. No. 60/024,277, filed Aug. 21, 1996.

BACKGROUND OF THE INVENTION

1. Field of the Invention

The present invention relates to lounge chairs. More specifically, the invention is a lounge chair that sprays a fine mist on the occupant.

2. Description of the Related Art

Leisure in the sun involves anything from sunbathing for the purpose of tanning to napping or resting outdoors while exposed to the sun. However, one either perspires in the heat of the sun or, at the other extreme, dehydrates one's exposed skin. At either extreme, a refreshing spray of water is often needed. The many attempts to obtain such a spray have been complicated by considerations of construction integrity, the aesthetics of sun lounging chairs, and hydraulic engineering to obtain a water tight pressure system.

Lounge furniture should be low cost, ergonomically adjustable, aesthetically pleasing, capable of withstanding hard outdoor use and even abuse, lightweight, and easily transported and stored. This has been achieved in the simple sun lounge, but not generally available in spray or misting lounges.

The prior art of lounge chairs that employ cooling water includes: U.S. Design Pat. No. 297,991 of Boyle, Jr.; U.S. Design Pat. No. 309,836 of Meredith et al.; U.S. Pat. No. 3,625,434 of Kitover; U.S. Pat. No. 4,548,357 of Schmidt; U.S. Pat. No. 4,765,542 of Carlson; U.S. Pat. No. 4,846,525 of Manning; U.S. Pat. No. 4,854,502 of Cox; U.S. Pat. No. 4,961,535 of Skibik; U.S. Pat. No. 5,000,384 of Arnold; U.S. Pat. No. 5,156,339 of Gibson et al.; U.S. Pat. No. 5,322,342 of Gange; Foreign Patent Number 578,378 from the EP published in January 1994; and Foreign Patent Number WO 94/17695 published in August 1994.

Upon review of the enclosed patent references, it is noted that lounge chairs which mist the occupant have been the subject of earlier patents of particular interest is the patent to Gange which discloses a chaise lounge having an integral misting system. The misting system is a continuous loop joined to a "T" connector which attaches on the inner side of the chair frame between the webbing. Four spray zones, two on each side of the user, are provided. The third arm of the "T" connector is threaded to attach to a conventional garden hose.

Furthermore, the patent to Boyle, Jr. discloses a water spray attachment for lounge chair. This design shows a tubing with a T-shaped water inlet and delivery ports, which attaches to the frame of the lounge chair. In addition, the patent to Schmidt discloses a sprinkler device for a lawn chair. The sprinkler device of Schmidt is a "U" shaped length of flexible hose, closed at one end and connected at the opposite end to a water source through a control valve.

The remainder of the above-listed patents were selected to further illustrate a variety of lounge chairs and devices that mist the occupant. The European patent application of 12/1994 describes a lounge chair that is tempered by water. The lounge of Meredith is a shallow water bath. Manning discloses an improvement on the misting lounge of Kitover which has spray heads in the frame of the chair. Carlson and Cox describe a self contained spray lounge which was improved by Gibson. Skibik has an attachable single tube source for the spray. Arnold incorporates a shower system into his spray lounge. The PCT patent of 8/1994 discusses a versatile lounge chair.

The related art examples described above depend primarily on directing water flow through a channel that is contiguous with and defined by the structural tubing of the chair, thus exposing the chair structural system to damage, corrosion or problems in pressure water seals. Simplicity is achieved in the present invention, however, by flowing the water through a flexible small diameter plastic tubing system channeled internally of the lounge structural frame. There is now commercially available water spray hardware employing small diameter plastic tubing and easily constructed watertight joints using compatible small T-connectors, elbows, unions to hose bibs and spray heads that mist. Such water spray hardware withstands pressure surges that occur in commercial water supplies, and has alleviated most of the traditional problems of channeling water. Moreover, because the pressurized water system is internal and independent of the frame, greater latitude is afforded to the aesthetics of the lounge chair design than is available from the teachings of the prior art.

None of the above prior art inventions and patents, taken either singularly or in combination, is seen to describe the instant invention as claimed. Thus a misting chair solving the aforementioned problems is desired.

SUMMARY OF THE INVENTION

The present sun lounge is simple, low cost, ergonomically adjustable, aesthetically pleasing, capable of withstanding hard outdoor use and even abuse, lightweight, and easily transported and stored. Commercially available garden hardware is used which is small, flexible and capable of delivering a fine mist. The invention is a novel combination of the two independent systems of a practical lounge chair and a water misting system. In this combination, a small spray head assembly of a misting device and a conduit available from garden hardware, for example, is inserted into the tubular frame member of a lounge chair through a minimally sized mounting hole or port, into a T-connector provided in a water line made of plastic tubing, and installed in the chair frame member. Because of the small diameter of the pressurized tubing, it easily snakes and flexes through the pivotal attachments which make sun lounging chairs so versatile and convenient. By channelling small diameter plastic tubing through the frame of a lounge chair and setting the small misting heads through the frame at appropriate locations, a misting lounge is obtained in which there is a good balance in achieving a optimum mist in a practical lounge.

The plastic tubing carrying pressurized water passes into and channels through the hollow frame of the lounge chair; such assembly is readily accomplished in a factory setting. Such narrow diameter plastic tubing easily threads through the frame and about the pivots of the lounge chair. The tubing connects on one end to a garden hose, hose bib or other means of delivering water, through an "on-off" control valve. At critical points, mounting holes or ports are cut into the frame which permits the insertion of assemblies of a misting device and a conduit into T-connectors provided in and spaced along the previously inserted plastic tubing. Thus, these misting devices are set into and spaced along the frame. Because of the small size of the misting assembly, no structural integrity of the lounge chair is compromised.

Accordingly, it is a principal objective of the invention to achieve in a sun lounge a water misting system to assure a sun bather will be comfortably sprayed while lounging.

It is another objective of the invention to create a misting lounge that will be low cost, adjustable, aesthetically pleasing, capable of withstanding hard use, light weight, and easily transported and stored.

It is an objective of the invention to provide improved elements and arrangements thereof in a misting chair for the purposes described which is inexpensive, dependable and fully effective in accomplishing its intended purposes.

These and other objectives of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
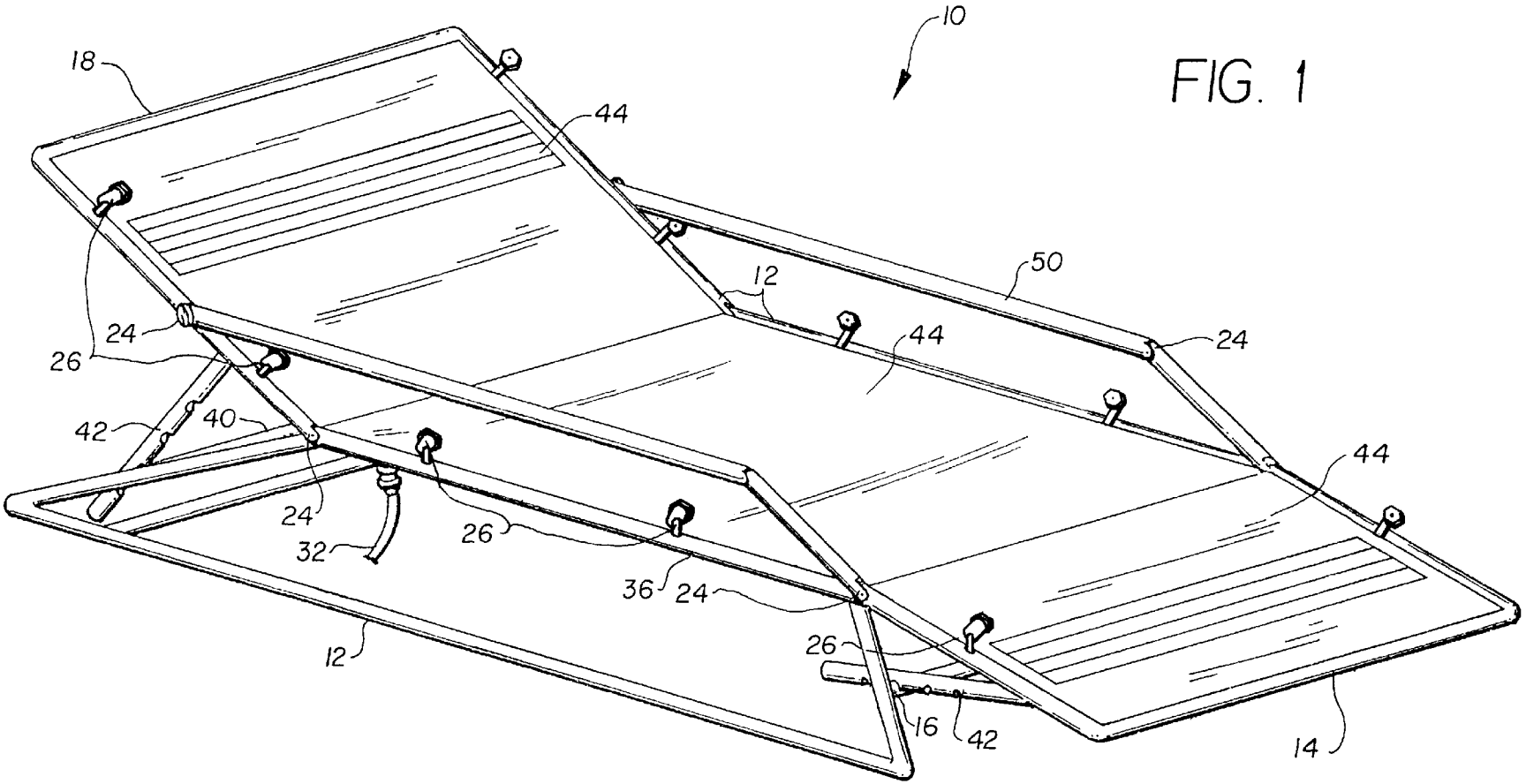
FIG. 1 is a perspective view of the mister chair.

The present invention, a misting lounge chair 10, is shown in FIG. 1. The basic chaise lounge may include two adjustable sections, a leg frame 14 and a head frame 18, which are attached to the seat frame 36 by pivotal attachments 24 at all frame junctions. The adjustable head frame 18 and the leg frame 14 are held in place by adjusters 42, each of which is a slotted bar which engages the leg frame cross member 16 and head frame cross member 40. These cross members also add structural rigidity to the lounge chair 10. Of course, the particular and specific chair just described is simply exemplary of a wide number of structurally variable chairs and lounges which are suitable for modification in accordance with the teachings of the instant invention.

Misting devices 26 are placed strategically and/or symmetrically throughout the frame, there further being internal tubing feeding water to the misting devices 26, the tubing being fed from the water input hose bib 32, all as discussed in greater detail hereinbelow. Additionally, and as is readily apparent from an inspection of FIG. 1, the misting devices are angled upwardly, so as to direct a fine misting spray gently upward and over the user of the chair.

The chair is covered, for example by a webbing or parallel plastic strands or tubes 44, for comfortably supporting a sunbather. The chair is structured from tubular frame members 12 which may be metal or even strong plastic. There are pivotal interconnections 24 at all movable joints, present in the arm rests 50, head frame 18, and leg frame 14. Such pivotal attachments 24 permit the lounge chair 10 to adjust from a upright seat to a flat cot configuration, and do not have components that would occlude the free passage of the small diameter water tubing 30 and the T-connectors 34. One such pivotal interconnection could be a pair of short straps connected to the tubular frame by blind rivets; other pivotal structures are known and are available in the art. Mechanical integrity as dictated by the art is also implied in the construction of the chair to affirm utility.

Figure 2:
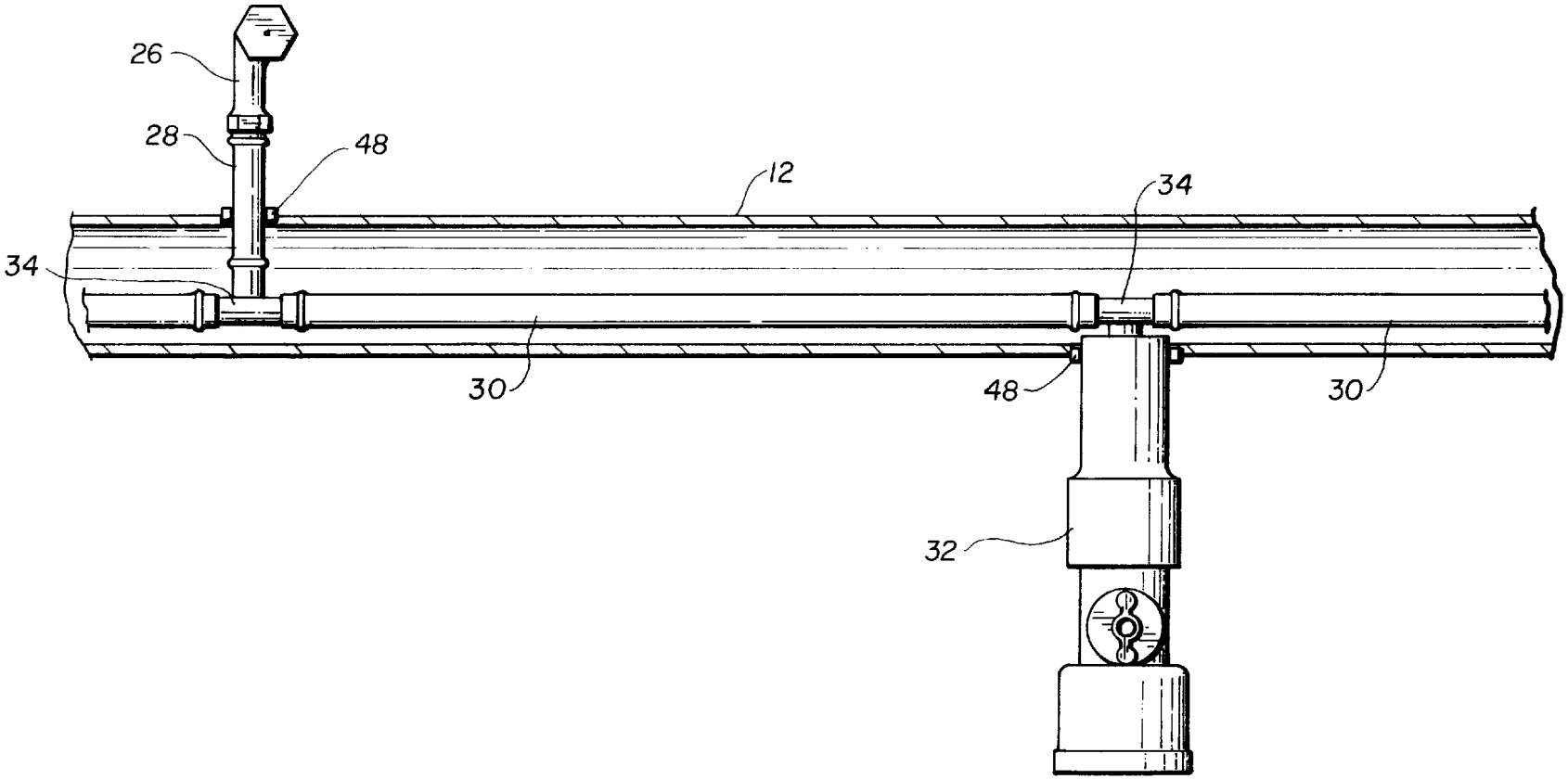
FIG. 2 is an enlarged scale, sectional view of a spray head assembly and a hose bib set in a tubular frame member.

Shown on the left side of FIG. 2 is the assembly of misting device 26, conduit 28, T-connector 34 and tubing 30. The assembly is illustrated mounted through a tubular frame member 12, with the misting device 26 set to a conduit or riser 28, which penetrates the frame member through a grommet 48. Misting devices are small spray heads designed to deliver a fine spray which aerate and are commonly available in the horticulture arts for watering tropical plants and ferns, for example. They are typically small, have attachment barbs which seal and hold against commercial water pressure stresses, and some have integral flow regulators.

Shown in FIG. 2 is the mounted hose bib 32 which is also set to a tee or T-connectors 34, which is in turn inserted within the tubing 30. The grommetted hole (at 48) is dimensioned to permit adequate frame access and working space to firmly set the components. The water spray system hardware described or required in the practical assembly of the subject water system is available as generally compatible hardware, and includes elbows, tubing 30 and short pieces thereof designated as conduits 28, T-connectors 34, and water input hose bibs 32. Exemplary product lines of such hardware are made different manufacturers under the registered trademarks Spears and Gilmour. More specifically, the conduits 28 is suggestive of one of the components of the Spears USA "F-64P" model line. Likewise, the hose bib 32 is suggestive of the Gilmour 07-V Nylon Water Shut-Off Valve manufactured by Gilmour Group, a division of Vermont American, in Louisville, Ky. These products are distinguishable from ordinary plumbing parts by their somewhat miniaturized structure as intended for agricultural or horticultural applications.

Installing the water system in the chair is uncomplicated. The hole or port (associated with grommet 48) is made in the frame of the chair at the predetermined and desired intervals. Tubing 30 with T-connectors 34 spaced at equal intervals is subsequently threaded through the appropriate upper frame members 12. Each T-connectors 34 is thus pre-positioned to align with each of the holes in the frame. Conduits 28 provided with grommets 48 are inserted through the holes or ports, each conduits 28 threaded into its tee 34 and each grommet 48 firmly seated in each hole. The conduits 28 may be equipped with misting devices 26 already attached when connected to the tee 34.

Otherwise, the seated risers 28 are fitted with the misting device 26.

Thereafter, the hose bib 32 is installed in a similar fashion, and this completes the assembly and installation of the misting components to the chair. Of course, the type, number and placement of the misting devices 26 are variable as per model of lounge chair 10.

It is to be understood that the present invention is not limited to the embodiment described above, but encompasses any and all embodiments within the scope of the following claims.

I claim:

1. A misting chair comprising:

a plurality of tubular frame members including a plurality of upwardly directed mounting holes therein, one of said tubular frame members having a connection mounting hole therein;

tubing inserted through said tubular frame members, said tubing including T-connectors therein, there being one T-connector for each of said mounting holes;

a plurality of conduits, there being one conduit for each of said T-connectors, each conduit inserted through a respective one of said mounting holes and into a respective one of said T-connectors;

a plurality of misting devices, each misting device attached to a respective one of said conduits;

a connection T-connector in said tubing at said connection mounting hole; and a water input hose bib attached to said connection T-connector; whereby the misting chair has a plurality of misting devices arrayed along said frame members to provide a spray over and about the misting chair.

2. The misting chair as defined in claim 1, wherein each conduit attached to one of said misting devices is dimensioned and configured to project upwardly and at an angle with respect to a vertical plane.

3. A kit for converting a lounge chair having tubular frame members to a misting chair, said kit comprising:

a plurality of grommets for insertion into mounting holes in the tubular frame members;

tubing having a plurality of T-connectors and a connection T-connector, said tubing for insertion into the tubular frame members;

a plurality of conduits for attachment to said T-connectors and insertion through said grommets;

a plurality of misting devices for attachment to said conduits;

and a water input hose bib connected to said connection T-connector.

4. A method for creating a misting chair from a lounge chair with tubular frame members, said method comprising the steps of:

forming a plurality of mounting holes through the tubular frame members;

inserting a grommet into each of the mounting holes;

inserting tubing having a plurality of T-connectors therein into the tubular frame members;

attaching a conduit to each of the T-connectors;

attaching a misting device to each of the conduits; and connecting a water input hose bib to the tubing; whereby a misting chair is created having a plurality of misting devices arrayed along the frame members, for providing a spray over and about the lounge chair.

* * * * *